United States Patent [19]

Achelpohl

[11] Patent Number: 4,759,742

[45] Date of Patent: Jul. 26, 1988

[54] PROCESS OF MAKING T-SHIRT BAGS

[75] Inventor: Fritz Achelpohl, Lengerich, Fed. Rep. of Germany

[73] Assignee: Windmöller & Hölscher, Lengerich, Fed. Rep. of Germany

[21] Appl. No.: 35,469

[22] Filed: Apr. 7, 1987

[30] Foreign Application Priority Data

Apr. 21, 1986 [DE] Fed. Rep. of Germany ..... 3613427

[51] Int. Cl.[4] ..... B31B 25/64; B31B 37/86

[52] U.S. Cl. ..... 493/195; 493/243; 493/254; 493/926

[58] Field of Search ..... 493/193, 194, 195, 196, 493/197, 198, 243, 254, 926

[56] References Cited

U.S. PATENT DOCUMENTS

| | | | |
|---|---|---|---|
| 3,023,679 | 3/1962 | Piazze | 493/194 |
| 3,349,991 | 10/1967 | Kessler | 493/194 |
| 3,729,361 | 4/1973 | Westlake, Jr. | 493/197 |

*Primary Examiner*—Frederick R. Schmidt
*Assistant Examiner*—William E. Terrell
*Attorney, Agent, or Firm*—Fleit, Jacobson, Cohn & Price

[57] ABSTRACT

In a process of making T-shirt bags a flat tubular film that is provided on each side with at least one gusset is provided with top end seam welds, which close the gusset portions to form handle loops, and with cutouts, which are similar to the neckline of a T-shirt and extend through the inner creases of the side gussets, and the tubing is then folded on itself about its longitudinal center line and is thereafter formed at its bottom end with seam welds, which join all plies, and is formed between adjacent top end and bottom end seam welds with transverse perforation lines or with hot wire-welded joints to separate adjacent bags from each other. Before the folding of the tubular film on itself about its longitudinal center line those portions of the tubular film which are subsequently provided with the top end seam welds are provided with layers of a release agent which extend across the web and prevent a welding of the web. The tubular film is subsequently folded on itself so that the release agent layers lie on each other. The tubular film which has been folded on itself is subsequently provided with the top end and bottom end seam welds.

2 Claims, 4 Drawing Sheets

PROCESS OF MAKING T-SHIRT BAGS

BACKGROUND OF THE INVENTION

1. Field of the Invention

This invention relates to a process of making T-shirt bags, in which a flat tubular film that is provided on each side with at least one gusset is provided with top end seam welds, which close the gusset portions to form handle loops, and with cutouts, which are similar to the neckline of T-shirt and extend through the inner creases of the side gussets, and the tubing is then folded on itself about its longitudinal center line and is thereafter formed at its bottom end with seam welds, which join all plies, and is formed between adjacent top end and bottom end seam welds with transverse perforation lines or with hot wire-welded joints to separate adjacent bags from each other.

2. Description of the Prior Art

A conventional process of that kind serves to make T-shirt bags which are known from Published German Application No. 25 26 961 and are provided with so-called crownlike bottom ends. That convention process will now be explained more in detail with reference to FIG. 8 of the drawing. In a first stage of the process a tubular film 2 which has been formed with side gussets 1 is provided with cutouts 3 which are similar to the neckline of a T-shirt, also with top end seams 4 and with transverse perforation lines 5 along which adjacent bags can be torn apart. The tubular film which has thus been prepared is subsequently folded on itself about its longitudinal center line by means which are not shown and the folded tubular film is then provided at its bottom end with seam welds 6 which join all plies of the web.

That known process of making T-shirt bags having crownlike bottom ends is highly expensive because it requires an apparatus comprising two welding stations, which must be spaced a large distance apart because the folding station is disposed between them. Besides, the known apparatus for making T-shirt bags having crownlike bottom ends requires an expensive control system to ensure that the seam welds to be made by the two welding devices will be successively formed in proper positions first on the tubular film which has not yet been folded on itself and subsequently on the tubular film which has been folded on itself.

SUMMARY OF THE INVENTION

It is an object of the invention to provide a process which is of the kind described first hereinbefore and which permits T-shirt bags having crownlike bottom ends to be made with a less expensive apparatus.

In a process of the kind described first hereinbefore that object is accomplished in that before the folding of the tubular film on itself about its longitudinal center line those portions of the tubular film which are subsequently provided with the top end seam welds are provided with layers of a release agent which extend across the web and prevent a welding of the web, the tubular film is subsequently folded on itself so that the release agent layers lie on each other, and the tubular film which has been folded on itself is subsequently provided with the top end and bottom end seam welds. The process in accordance with the invention can be carried out by means of an apparatus in which only one welding station is required so that the capital investment is reduced and the seam welds can be made in a simple manner in the proper positions relative to each other.

The tubular film is suitably die-cut to form cutouts which are similar to the neckline of a T-shirt when the tubular film has been folded on itself and provided with the top and bottom end seam welds. In that case the die-cut cutouts may be relatively small because the tubular film has previously been folded about its center line.

DETAILED DESCRIPTION OF THE PREFERRED EMBODIMENT

Figure 1:
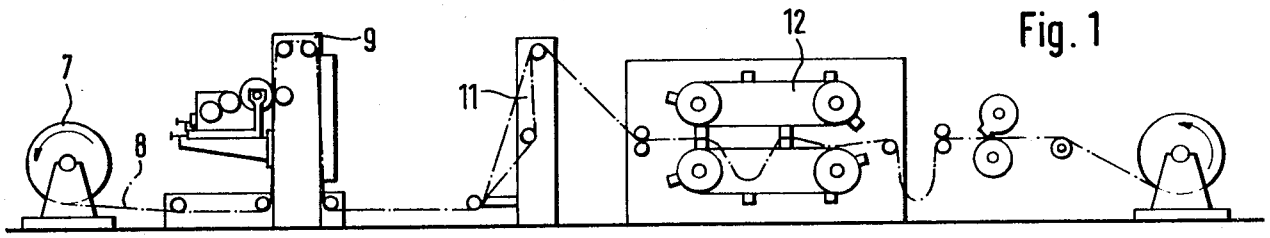
FIG. 1 is a diagrammatic side elevation showing an apparatus for making T-shirt bags having crownlike bottom ends.

An illustrative embodiment of the invention will now be explained more in detail with reference to FIGS. 1 to 7 of the drawing.

In the apparatus shown in FIG. 1 a tubular film 8 previously formed with side gussets is withdrawn from a supply roll 7 and is then moved through an applicator 9, in which the tubular film 8 is provided on one side with equally spaced apart strips 10 of a release agent, which prevents a welding of the film. Said strips extend throughout the width of the tubular film 8. The tubular film 8 is then passed through a conventional folding device 11, which contains a folding triangle and in which the tubular film is folded on itself about its longitudinal center line so that the release agent strips 10 lie on each other in the folded tubular film.

When the tubular film 8 has thus been folded, it is passed through a welding station 12, in which the tubular film 8 is provided with the top end seam welds 13 and the bottom end seam welds 14.

Figure 2:
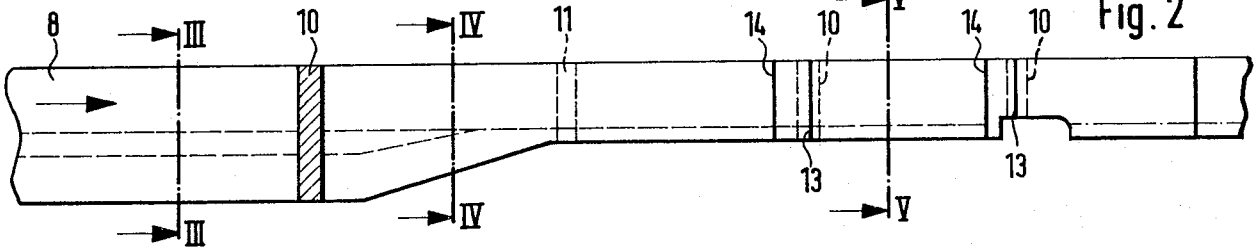
FIG. 2 is a top plan view showing the tubular film being processed in the apparatus of FIG. 1. The processing steps carried out in the several processing stations are clearly illustrated.
Figure 3:
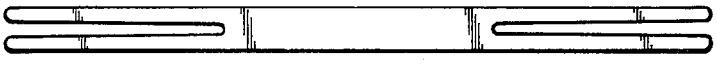
FIGS. 3 to 5 are sectional views taken on the lines III—III, IV—IV, and V—V, respectively.
Figure 4:
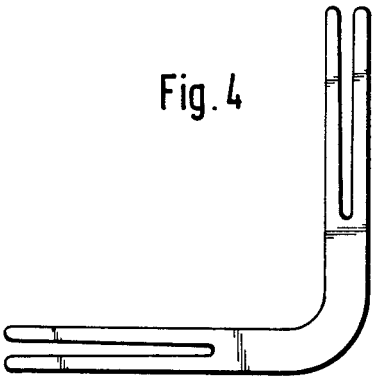
Figure 5:
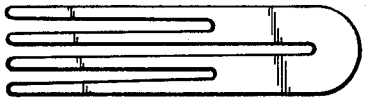

As is apparent from FIG. 2 the top end seams 13 extend in the areas in which the coating strips 11 consisting of the release agent have been applied so that in each of said areas the four plies above the release agent strips 10 are joined by welding and so are the four plies disposed under the release agent strips 10. As no release agent has been applied in the areas in which the bottom end seams 14 are formed, the resulting bag cannot be unfolded at its bottom end, where all eight plies of the folded tubular film 8 have been joined by the seam welds 14.

When the top end and bottom end seam welds have been formed, the folded tubular web 8 is formed in a cutting station with the die-cut cutouts which are similar to the neckline of a T-shirt. Said cutouts extend outwardly beyond the inner edges of the side gussets. The string of bags which has thus been formed is then wound up to form a supply roll as is shown in FIG. 1.

Figure 7:
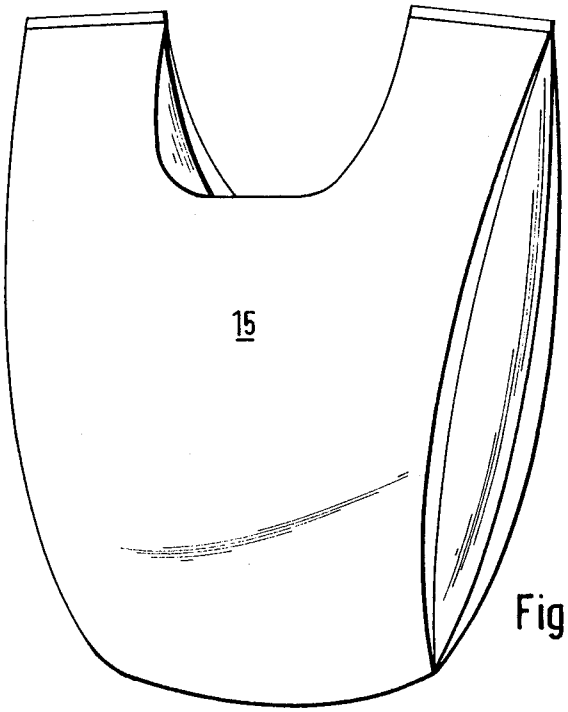
FIG. 7 shows a filled T-shirt bag of the kind shown in FIG. 6.
Figure 6:
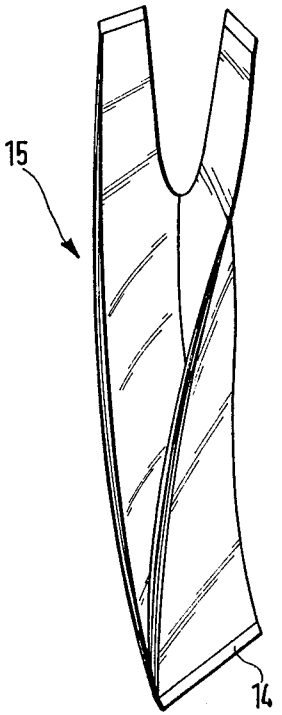
FIG. 6 shows a bag which has been torn from a string of bags made in accordance with FIG. 2 and which is still partly folded.
Figure 8:
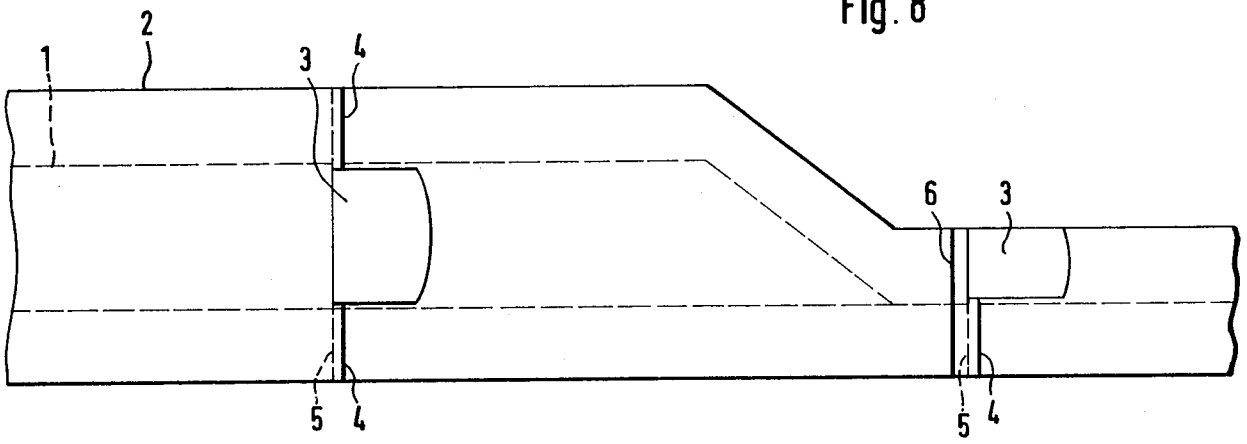
FIG. 8 is a top plan view showing a tubular film and illustrates the known process of making T-shirt bags having crownlike bottom ends.

When a T-shirt bag which has a crownlike bottom end has been torn along a transverse perforation line from the string of bags and has been filled, the bag has the appearance shown in FIG. 7.

I claim:

1. A process of making T-shirt bags, in which a flat tubular film is provided on each side with at least one gusset and is provided with top end seam welds, which close the gusset portions to form handle loops, and with cutouts, which are similar to the neckline of a T-shirt and extend through the inner creases of the side gussets including the steps of folding the gusseted tubing on itself about its longitudinal center line and thereafter forming transverse bottom end seam welds which join all plies, and forming transverse perforation lines or hot wire-welded joints between adjacent top end and bottom end seam welds to separate adjacent bags from each other, the improvement of the further steps of providing layers of a release agent which extend across the web in those portions of the tubular film which are subsequently provided with the top end seam welds and which prevent a welding of the web when the tubular film is subsequently folded on itself so that the release agent layers lie on each other, and subsequently providing the top end and bottom end seam welds after the tubular film has been folded on itself.

2. A process according to claim 1, wherein the tubular film is die-cut to form cutouts which are similar to the neckline of a T-shirt when the tubular film has been folded on itself and provided with the top and bottom end seam welds.

* * * * *